US009038304B1

(12) United States Patent
Hu

(10) Patent No.: US 9,038,304 B1
(45) Date of Patent: May 26, 2015

(54) GUN MAGAZINE

(71) Applicant: Shih-Che Hu, Tianan (TW)

(72) Inventor: Shih-Che Hu, Tianan (TW)

( * ) Notice: Subject to any disclaimer, the term of this patent is extended or adjusted under 35 U.S.C. 154(b) by 0 days.

(21) Appl. No.: 14/289,639

(22) Filed: May 28, 2014

(51) Int. Cl.

| | |
|---|---|
| ***F41B 11/50*** | (2013.01) |
| ***F41B 11/55*** | (2013.01) |
| ***F41A 9/64*** | (2006.01) |
| ***F41A 9/71*** | (2006.01) |

(52) U.S. Cl.
CPC .. *F41A 9/71* (2013.01); *F41B 11/50* (2013.01)

(58) Field of Classification Search
CPC ..... F41A 9/01; F41A 9/24; F41A 9/25; F41A 9/26; F41A 9/61; F41A 9/64; F41A 9/65; F41A 9/67; F41A 9/71; F41A 11/50; F41A 11/51; F41A 11/54; F41A 11/55; F41A 11/56
See application file for complete search history.

(56) References Cited

U.S. PATENT DOCUMENTS

| | | | | |
|---|---|---|---|---|
| 1,886,704 | A * | 11/1932 | Loomis | 124/52 |
| 2,296,729 | A * | 9/1942 | Mossberg | 42/50 |
| 4,329,802 | A * | 5/1982 | Coonan | 42/50 |
| 4,688,344 | A * | 8/1987 | Kim | 42/50 |
| 6,694,658 | B1 * | 2/2004 | Marsac | 42/54 |
| 2003/0056777 | A1 * | 3/2003 | Liang | 124/52 |
| 2006/0042613 | A1 * | 3/2006 | Hu | 124/48 |
| 2011/0078936 | A1 * | 4/2011 | Gates | 42/1.02 |
| 2011/0167695 | A1 * | 7/2011 | Faifer et al. | 42/50 |
| 2011/0303206 | A1 * | 12/2011 | Lu | 124/45 |
| 2012/0160225 | A1 * | 6/2012 | Cho | 124/52 |
| 2013/0086834 | A1 * | 4/2013 | Battaglia | 42/49.02 |
| 2014/0373415 | A1 * | 12/2014 | Faifer | 42/49.01 |

* cited by examiner

*Primary Examiner* — Bret Hayes
*Assistant Examiner* — Derrick Morgan
(74) *Attorney, Agent, or Firm* — Raymond Y. Chan; David and Raymond Patent Firm

(57) ABSTRACT

A gun magazine includes an outer shell, an inner shell mounted in the outer shell and including a top opening, a track extended from the top opening, a guide block supported on a spring member in a rear end of the track and movable in and out of the top opening, a bottom cover affixed to the inner shell and the outer shell at a bottom side, and an adjustment member including a lever inserted through an elongated slot in the bottom block, a pivot holder located at a top end of the lever and pivotally connected to the inner shell and a guide rod extended from the top end of the lever and terminating in a retaining tip that is movable in and out of the track to stop or not to stop the guide block subject to operation of the lever between two positions, thereby adjusting the bullet storage capacity of the track.

3 Claims, 11 Drawing Sheets

GUN MAGAZINE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to gun technology, and more particularly to a gun magazine, which allows adjustment of the bullet storage capacity of a track therein simply by means of operating a lever of an adjustment member to control the movable range of a guide block in the track.

2. Description of Related Arts

A gun magazine "a" for big toy gun generally comprises an outer shell 10, an inner shell 20 and a bottom cover 30. For allowing adjustment of the bullet storage capacity, an adjustment member 40 is provided. The outer shell 10 is a vertically extending double open ended shell. The inner shell 20 is mounted inside the outer shell 10. The bottom cover 30 is affixed to the bottom side of the inner shell 20 and the bottom side of the outer shell 10 (see FIG. 2), comprising an elongated slot 301 that is forced into engagement with a bottom flange 201 of the inner shell 20 (see FIGS. 2 and 3). Further, the inner shell 20 consists of a left shell member 202 and a right shell member 203. The inner shell 20 comprises an opening 205 located in a top side thereof, a track 204 defined therein in communication with the opening 205, a locating rod 206 located in a rear end of the track 204 remote from the opening 205, a spring member 207 having a first end 2071 facing toward the opening 205 and an opposing second end 2072 fastened to the locating rod 206, and a guide block 208 supported on the first end 2071 of the spring member 207 (see FIG. 4). The adjustment member 40 comprises a body 401 and a retaining tip 402. The body 401 is disposed inside the inner shell 20, having at least one, for example, two protruding blocks 4011 that extend out of the inner shell 20 (see FIG. 1) for operation by the user to move the adjustment member 40 in shifting the retaining tip 402 toward an inner side or an outer side (see FIG. 6 and FIG. 5). When the retaining tip 402 is moved toward the outer side, the bullet storage capacity of the track 204 is adjusted to a low level condition (half capacity for receiving about 30 pcs air soft bullets). When a predetermined amount of airsoft bullets 50 (30 pcs) is inserted through the opening 205 into the track 204, the guide block 208 will be moved in the track 204 and then stopped by the retaining tip 402 (see FIG. 5). On the contrary, when the retaining tip 402 is moved toward the inner side, the bullet storage capacity of the track 204 is adjusted to a high level condition (full capacity for receiving about 60 pcs airsoft bullets 50).

The above-described prior art design allows adjustment of the bullet storage capacity. However, it is still not satisfactory in function. Because the adjustment member 40 is mounted inside the inner shell 20 and the protruding blocks 4011 are disposed between the inner shell 20 and the outer shell 10, the user needs to detach the bottom cover 30 and then remove the inner shell 20 out of the outer shell 10 for operating the protruding blocks 4011 to adjust the position of the adjustment member 40. This adjustment procedure is complicated and inconvenient.

SUMMARY OF THE PRESENT INVENTION

The present invention has been accomplished under the circumstances in view. It is one object of the present invention to provide a gun magazine, which is conveniently operable to adjust the bullet storage capacity.

To achieve this and other objects of the present invention, a gun magazine of the present invention comprises an outer shell, an inner shell, a bottom cover and an adjustment member. The outer shell is made in the form of a vertically extending double open ended shell. The inner shell is mounted inside the outer shell, comprising a track defined therein, an opening located in a top side thereof in communication with a front end of the track, a locating rod located in an opposing rear end of the track, a spring member mounted in the track and having a first end facing toward the opening and an opposing second end mounted on the locating rod, and a guide block supported on the first end of the spring member and movable in and out of the opening. The bottom cover is affixed to a bottom side of the inner shell and a bottom side of the outer shell, comprising an elongated slot disposed in communication with the track. The adjustment member comprises a lever inserted through the elongated slot of the bottom cover and having a top end disposed inside the outer shell and an opposing bottom end disposed outside the outer shell and terminating in an operating tip, a guide rod formed integral with the top end of the lever and terminating in a retaining tip, and a pivot holder formed integral with the top end of the lever and pivotally connected to the inner shell. The operating tip of the adjustment member is operable to move the lever between a first position in one end of the elongated slot and a second position in an opposite end of the elongated slot. The retaining tip is movable between an outer position where the retaining tip is shifted into the track to stop the guide block in a mid part of the track and an inner position where the retaining tip is shifted out of the track for allowing movement of the guide block toward the rear end of the track to compress the spring member. The retaining tip is shifted to the outer position when the operating tip is operated to move the lever to the first position. The retaining tip is shifted to the inner position when the operating tip is operated to move the lever to the second position.

Preferably, the guide block comprises a protruding portion located at a rear end thereof adapted for stopping against the retaining tip when the retaining tip is shifted into the track to stop against the guide block.

Preferably, the inner shell comprises a through hole. The pivot holder is pivotally connected to the inner shell to keep the adjustment member in between the inner shell and the outer shell. The guide rod comprises an angled rod body extended from the top end of the retaining tip and inserted through the through hole of the inner shell into the inside of the inner shell and terminating in the retaining tip.

The main feature of the gun magazine of the present invention is the design of the adjustment member such that the user can operate the operating tip in the elongated slot of the bottom cover to selectively shift the retaining tip in and out of the track to stop or not to stop the guide block. Thus, the invention facilitates adjustment of the bullet storage capacity without needing to detach the bottom cover.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
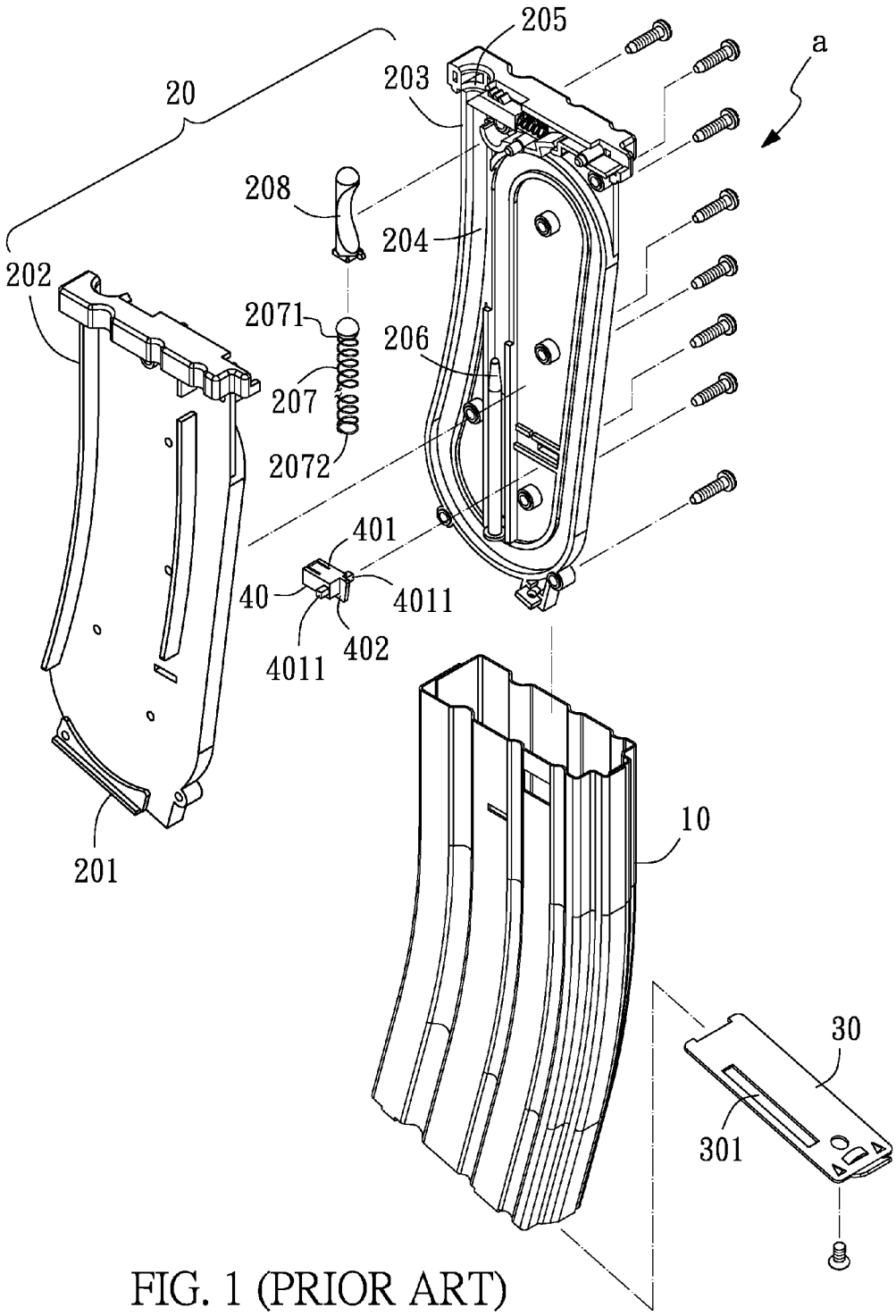
FIG. 1 (PRIOR ART)
FIG. 1 is an exploded view of a gun magazine according to the prior art.
Figure 2:
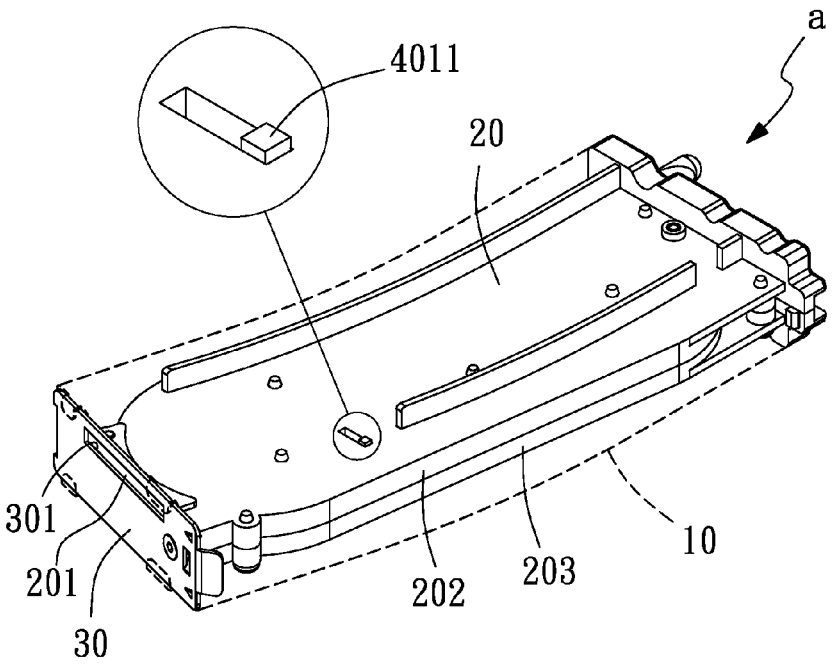
FIG. 2 (PRIOR ART)
FIG. 2 is a perspective assembly view of the gun magazine according to the prior art.
Figure 3:
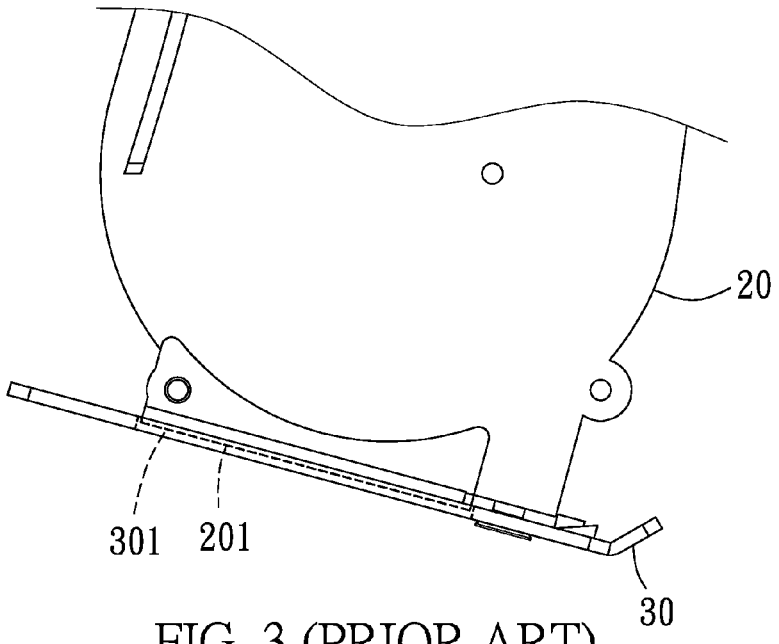
FIG. 3 (PRIOR ART)
FIG. 3 is a schematic plain view of a part of the gun magazine according to the prior art, illustrating the relationship between the inner shell and the bottom cover.
Figure 4:
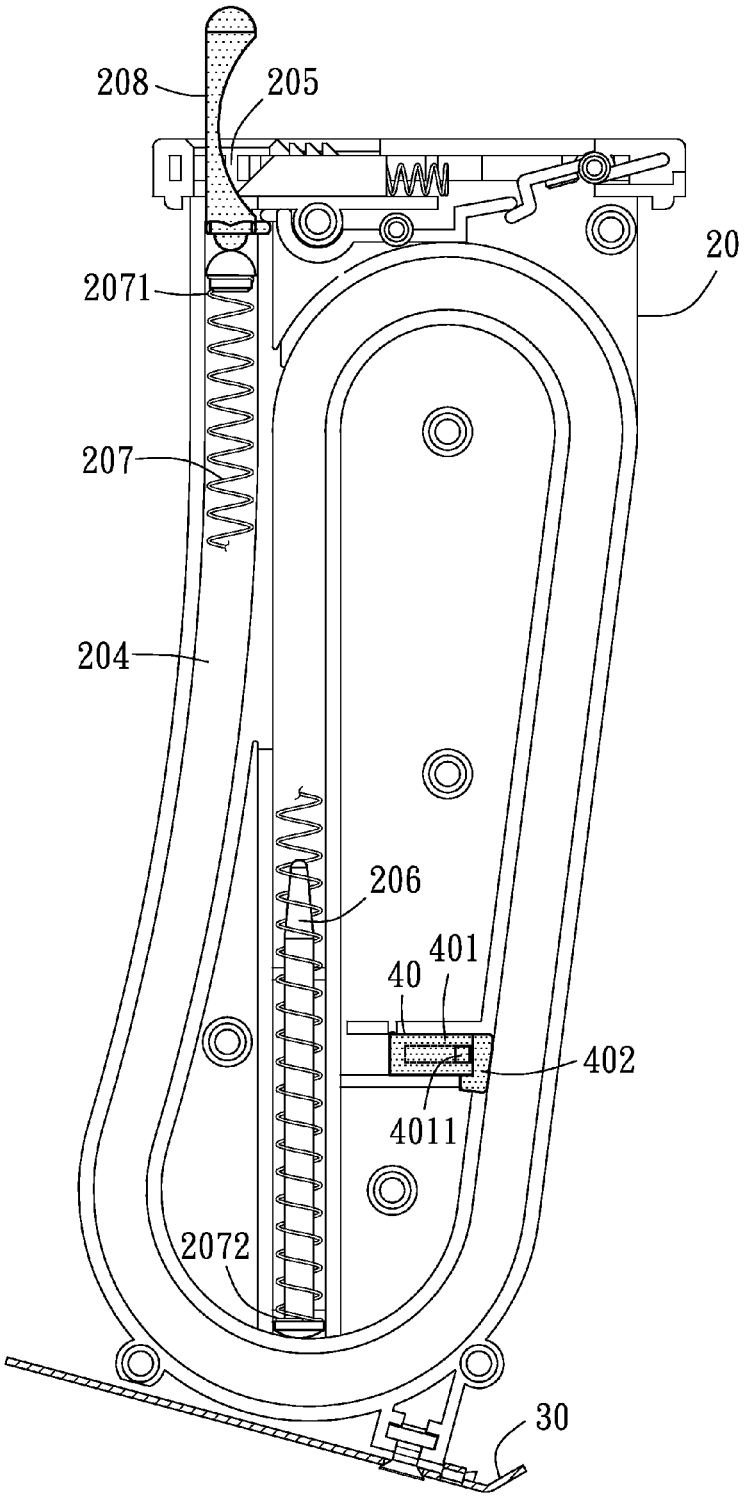
FIG. 4 (PRIOR ART)
FIG. 4 is a sectional view illustrating a status of the gun magazine according to the prior art before loading of airsoft bullet.
Figure 5:
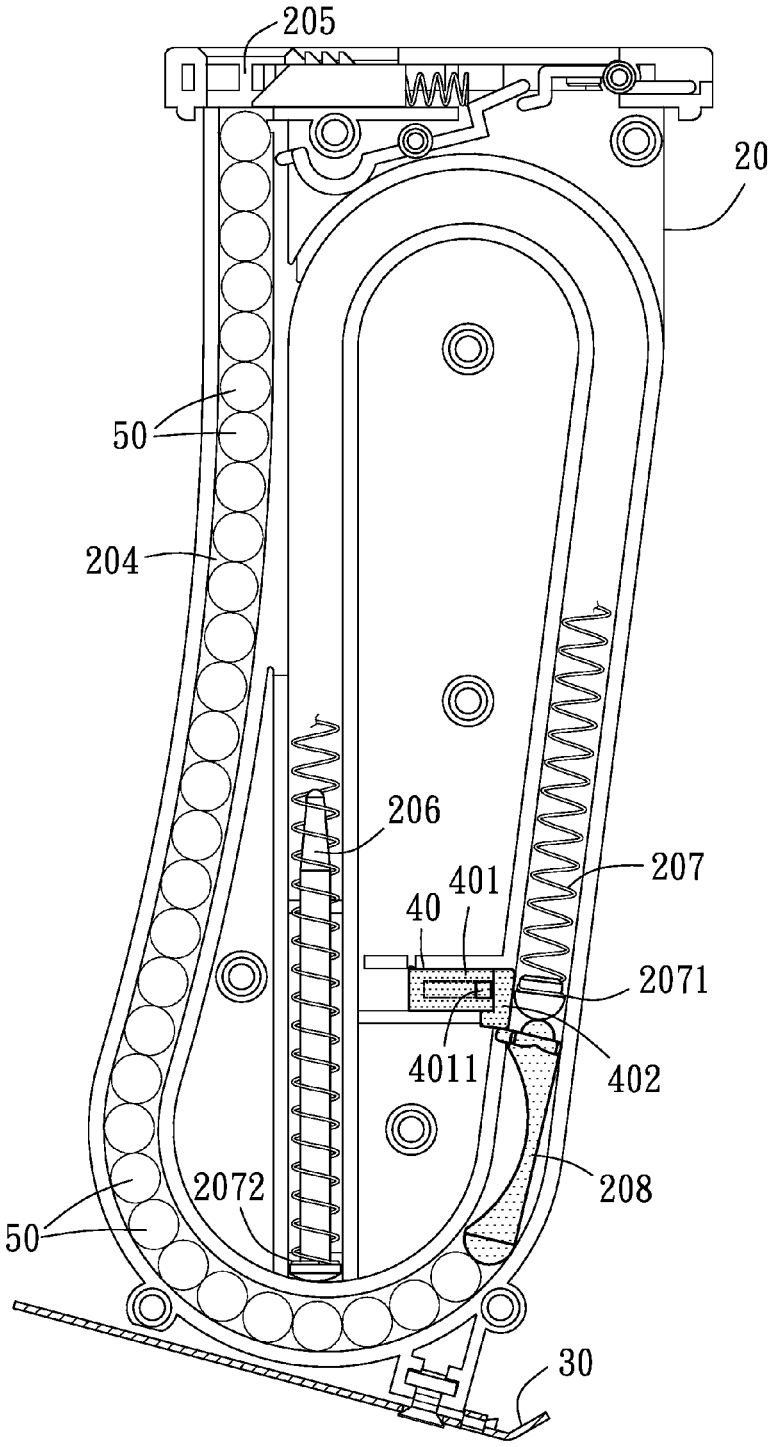
FIG. 5 (PRIOR ART)
FIG. 5 corresponds to FIG. 4, illustrating the bullet storage capacity of the track adjusted to a low level condition.
Figure 6:
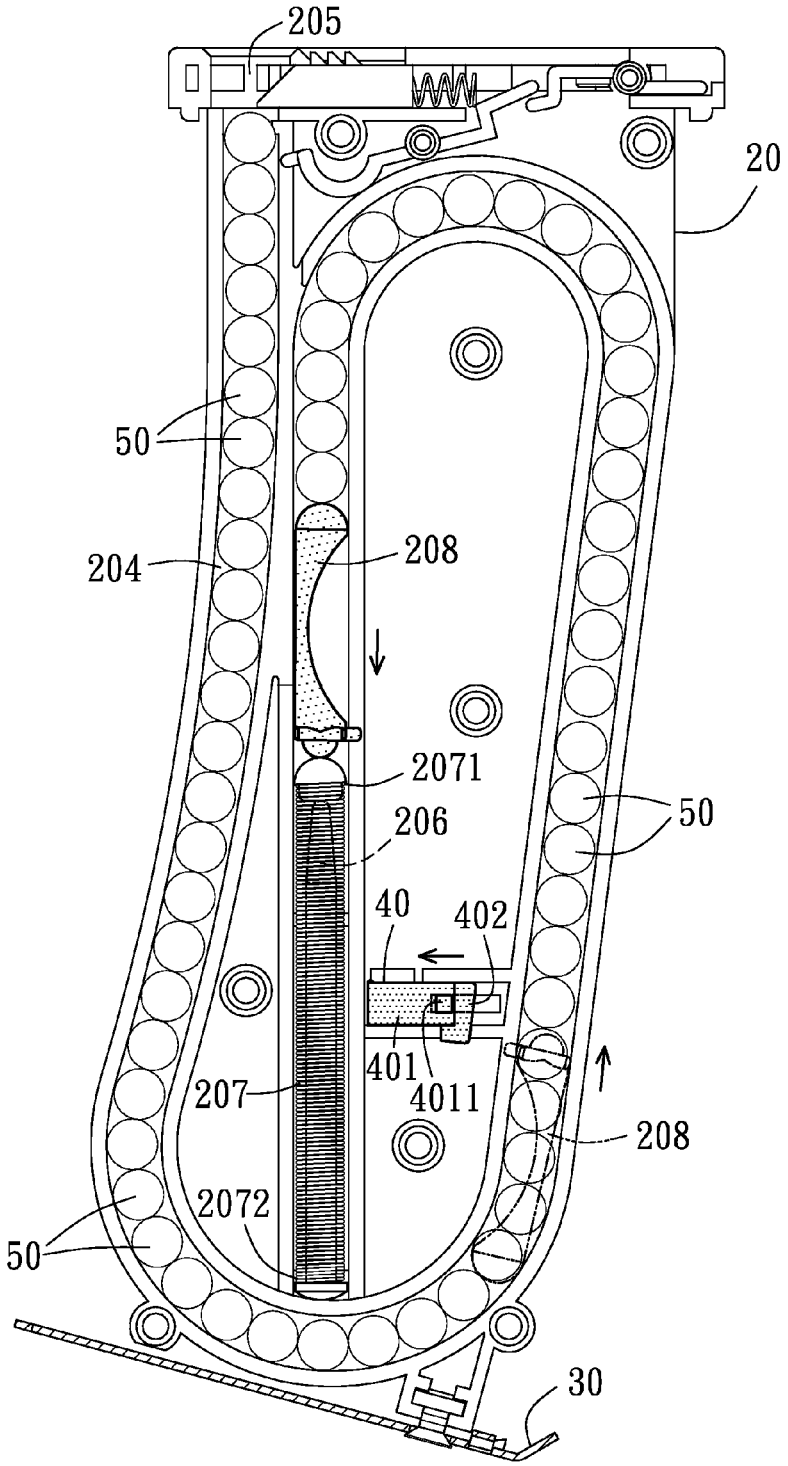
FIG. 6 (PRIOR ART)
FIG. 6 corresponds to FIG. 4, illustrating the bullet storage capacity of the track adjusted to a high level condition.
Figure 7:
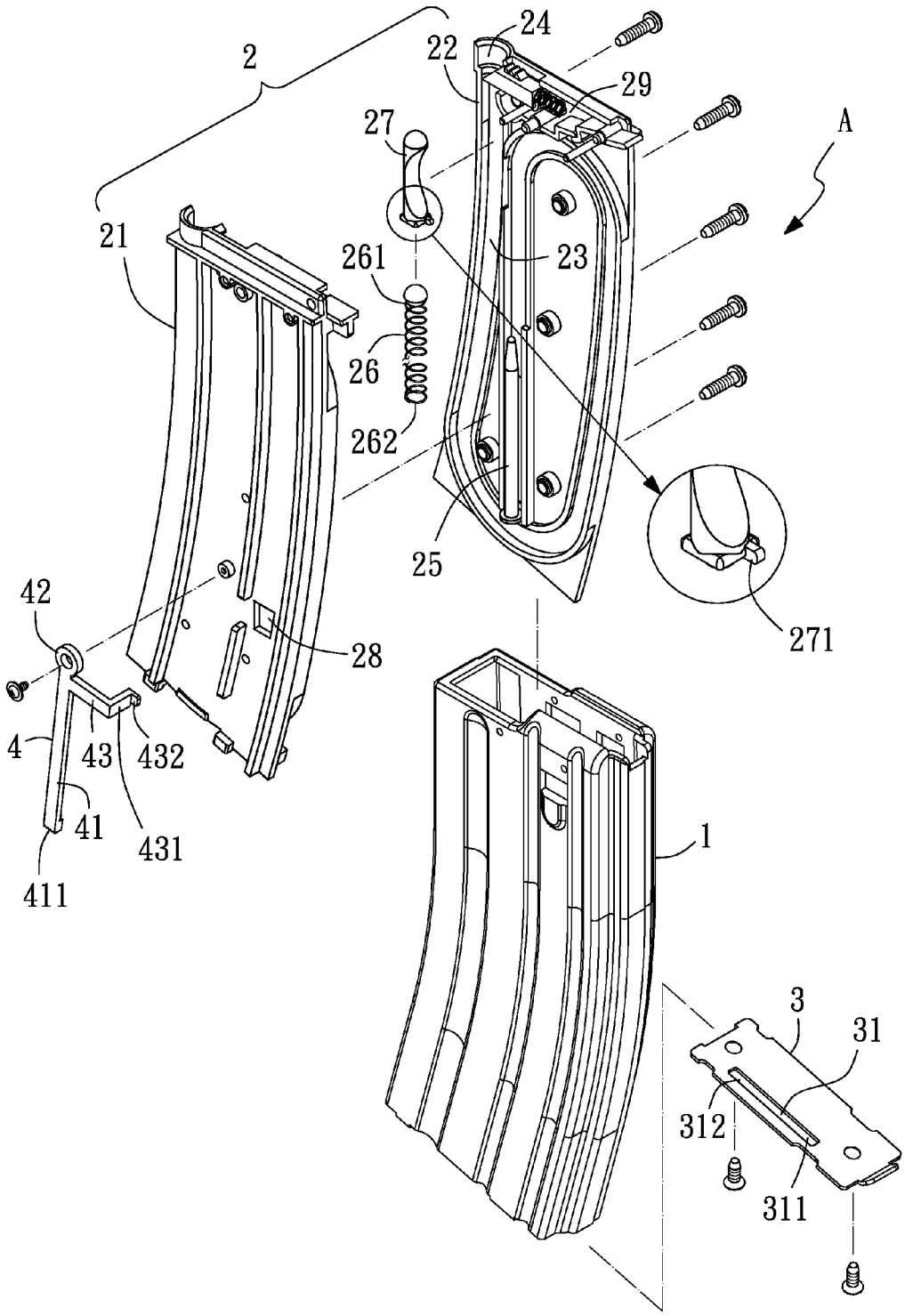
FIG. 7 is an exploded view of a gun magazine in accordance with the present invention.

Referring to FIG. 7, a gun magazine A in accordance with the present invention is shown. The gun magazine A comprises an outer shell 1, an inner shell 2, a bottom cover 3, and an adjustment member 4.

The outer shell 1 is a vertically extending double open ended shell.

The inner shell 2 is composed of a left shell member 21 and a right shell member 22 and mounted inside the outer shell 1, comprising a track 23 defined therein, an opening 24 located in a top side thereof in communication with a front end of the track 23, a locating rod 25 located in an opposing rear end of the track 23, a spring member 26 mounted in the track 23 and having a first end 261 facing toward the opening 24 and an opposing second end 262 mounted on the locating rod 25, a guide block 27 supported on the first end 261 of the spring member 26 and movable in and out of the opening 24 and having a protruding portion 271 located at a rear end thereof, a through hole 28 located in one side thereof, and a linkage 29 located at the top side thereof controllable to interrupt power supply after installation of the gun magazine A in the gun body of an electric gun. Because the linkage 29 of the known design and not within the scope of the spirit of the present invention, no further detailed description will be necessary in this regard.

The bottom cover 3 is affixed to the bottom side of the inner shell 2 and the bottom side of the outer shell 1, comprising an elongated slot 31 that defines a first position 311 in one end thereof and a second position 312 in an opposite end thereof.

Figure 8:
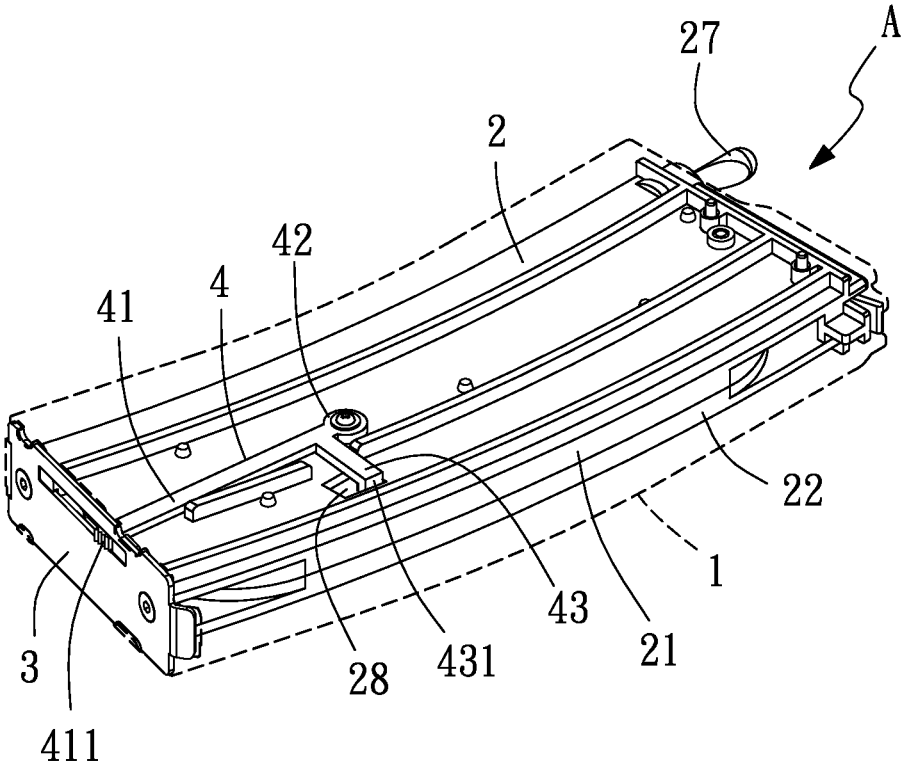
FIG. 8 is a perspective assembly view of the gun magazine in accordance with the present invention.
Figure 9:
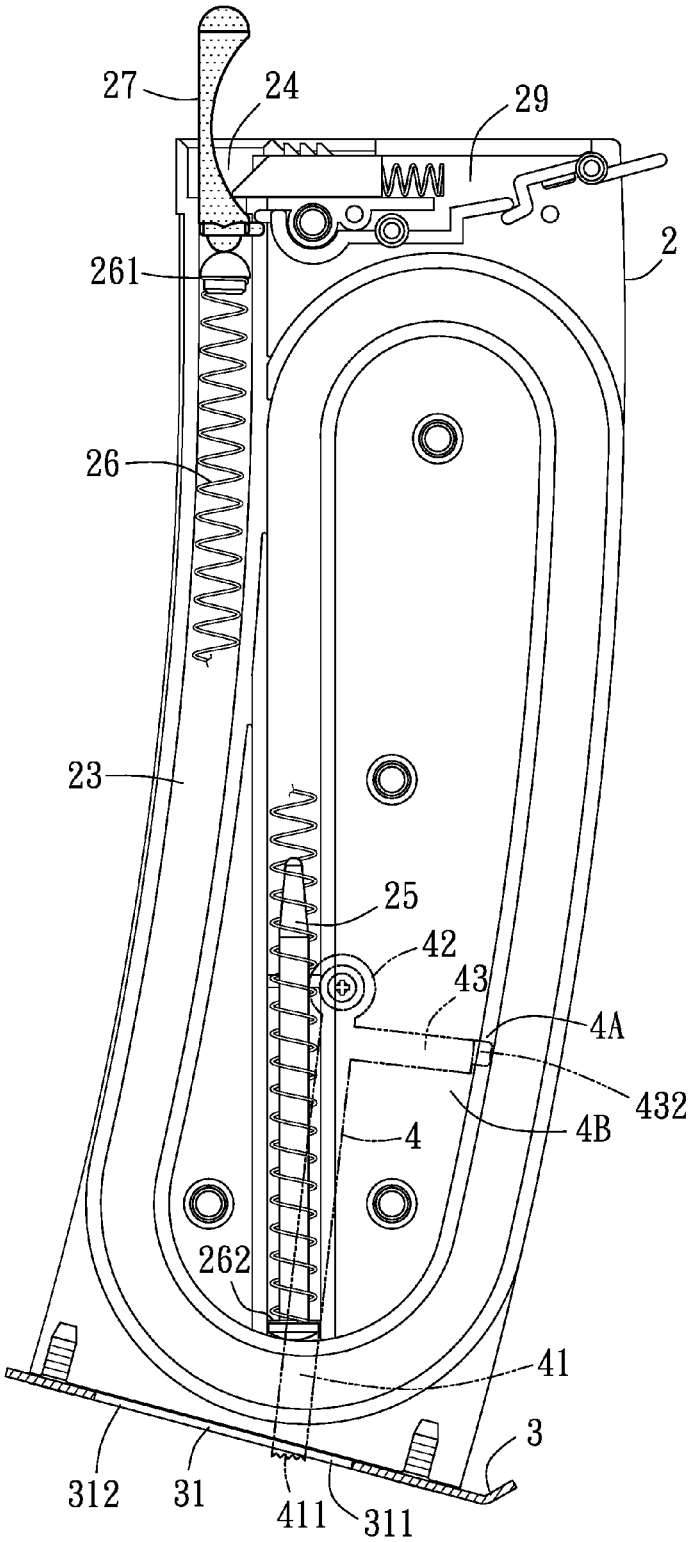
FIG. 9 is a sectional view illustrating a status of the gun magazine according to the present invention before loading of airsoft bullet.
Figure 11:
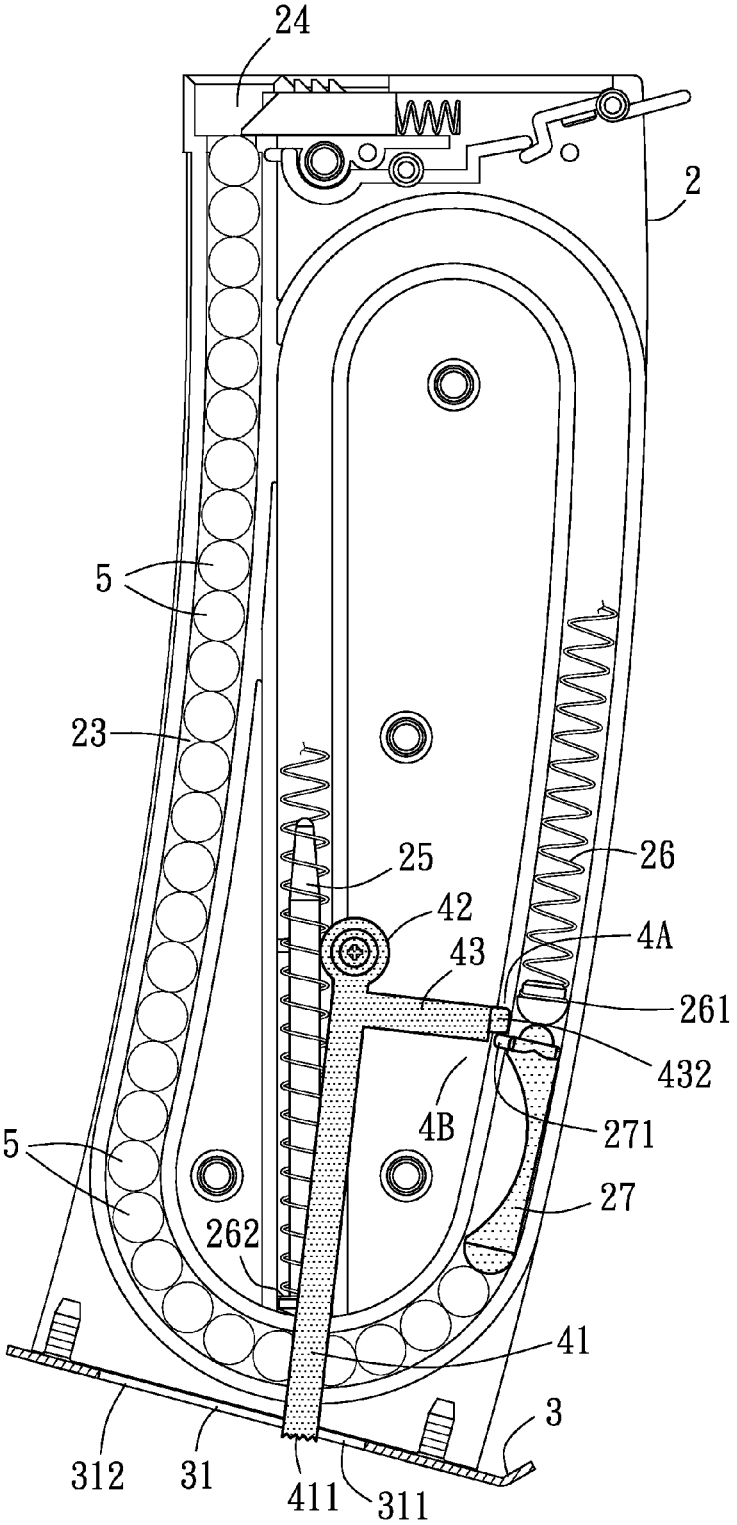
FIG. 11 corresponds to FIG. 10, illustrating the bullet storage capacity of the track adjusted to a low level condition.
Figure 12:
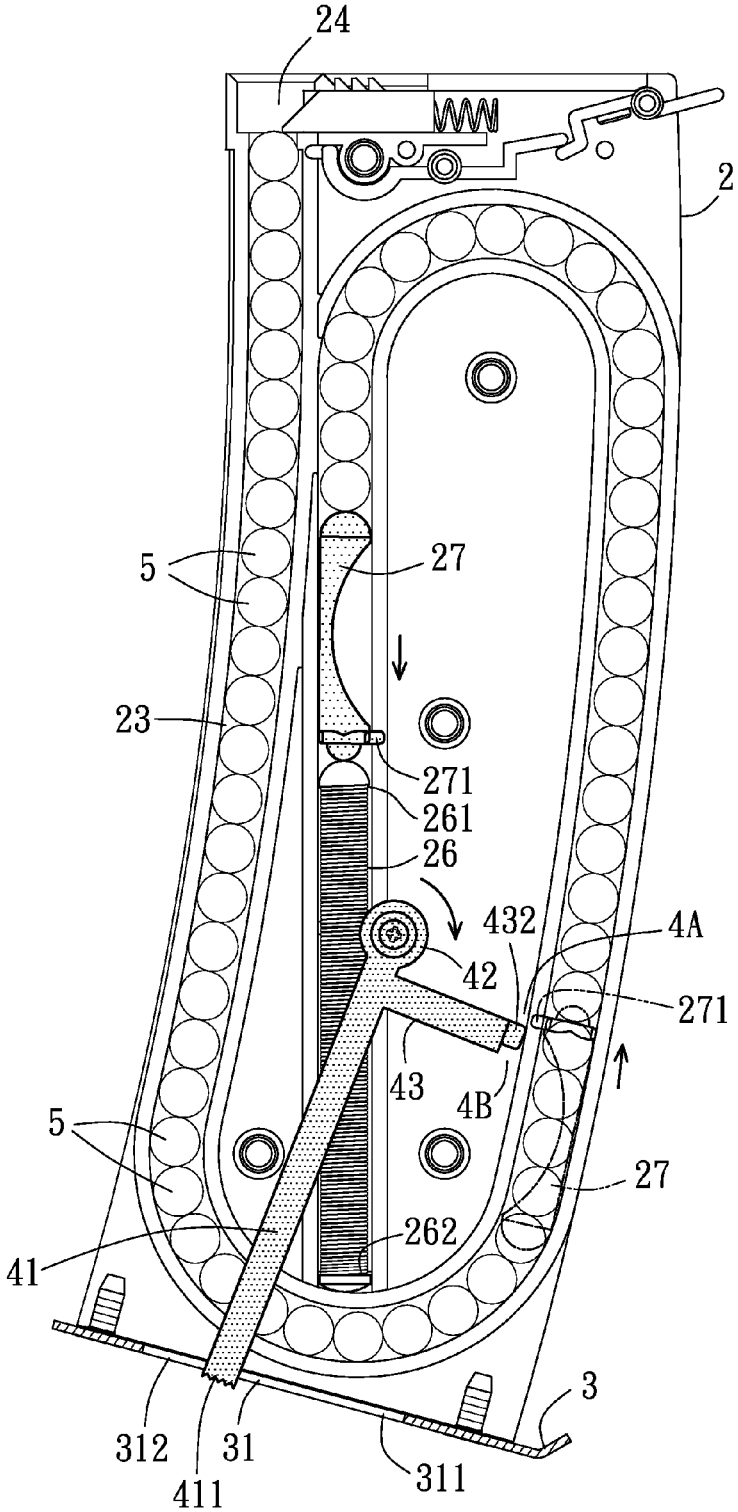
FIG. 12 corresponds to FIG. 11, illustrating the bullet storage capacity of the track adjusted to a high level condition.

The adjustment member 4 comprises a lever 41, a pivot holder 42 and a guide rod 43. By means of the pivot holder 42, the adjustment member 4 is pivotally connected to the outside wall of the inner shell 2 and disposed between the inner shell 2 and the outer shell 1. The lever 41 has a top end thereof formed integral with a part of the pivot holder 42 and a part of the guide rod 43, and an opposing bottom end thereof inserted through the elongated slot 31 of the bottom cover 3 to the outside of the outer shell 1 and terminating in an operating tip 411. The guide rod 43 has an angled rod body 431 extended from one end of the lever 41 and one end of the pivot holder 42 and terminating in a retaining tip 432. The angled rod body 431 is inserted through the through hole 28 into the inside of the inner shell 2 (see FIG. 8) to keep the retaining tip 432 in the inside of the inner shell 2. When operating the lever 41 to move the operating tip 411 to the first position 311 in the elongated slot 31 (see FIGS. 9-11), the pivot holder 42 of the adjustment member 4 will be biased relative to the inner shell 2 to move the retaining tip 432 to an outer position 4A; on the contrary, when operating the lever 41 to move the operating tip 411 to the second position 312 in the elongated slot 31 (see FIG. 12), the pivot holder 42 of the adjustment member 4 will be biased relative to the inner shell 2 to move the retaining tip 432 to an inner position 4B.

Figure 10:
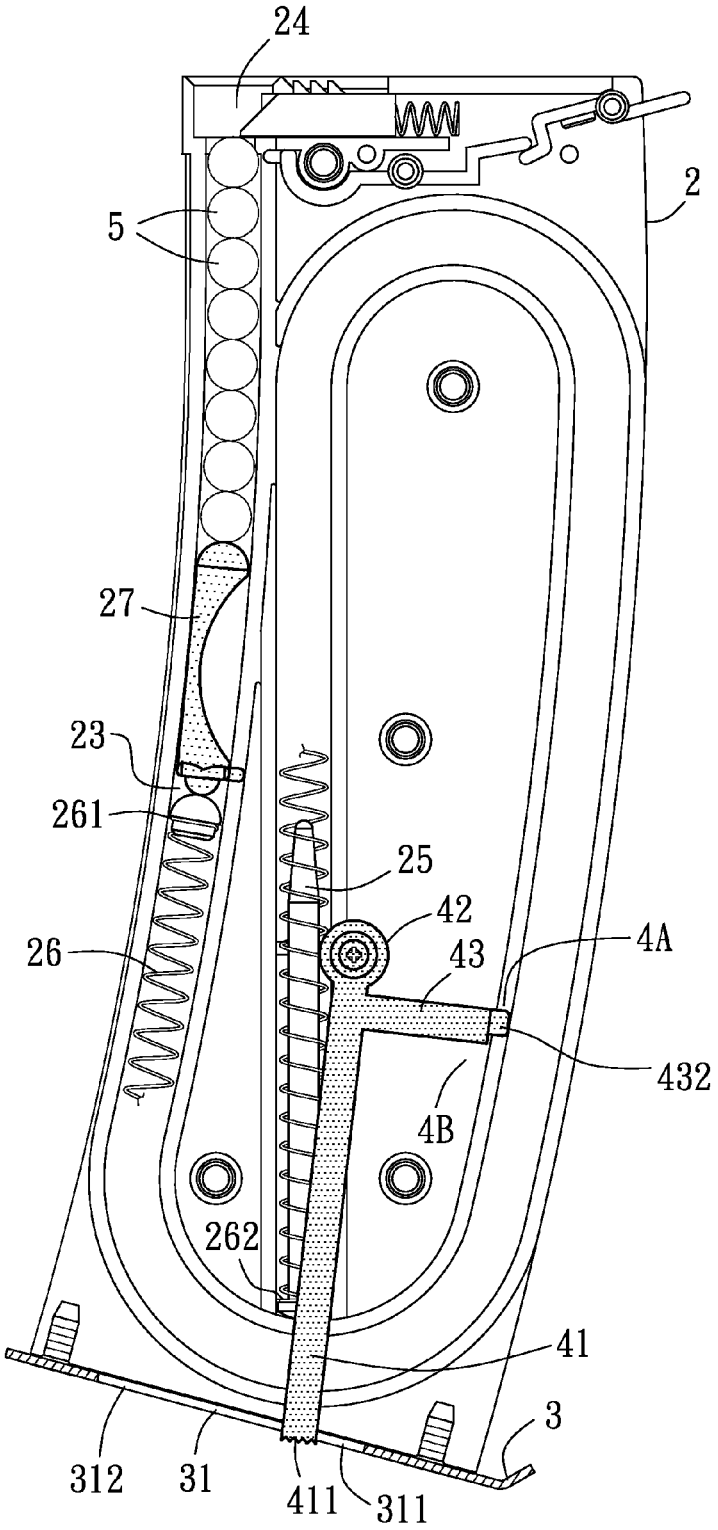
FIG. 10 corresponds to FIG. 9, illustrating insertion of a limited amount of airsoft bullets into the track.

In application, operate the lever 41 to move the operating tip 411 to the first position 311 in the elongated slot 31 (see FIG. 9-11) to bias the pivot holder 42 of the adjustment member 4 relative to the inner shell 2 to move the retaining tip 432 to an outer position 4A, then insert airsoft bullets 5 through the opening 24 into the track 23 against the top end of the guide block 27 (see FIG. 10). After insertion of a predetermined amount of airsoft bullets 5 into the track 23 to move the guide block 27 toward the rear end of the track 23 to the position where the protruding portion 271 is stopped against the retaining tip 432 (see FIG. 11), the guide block 27 is stopped in position to prohibit further insertion of any extra airsoft bullet 5 into the track 23. At this time, the bullet storage capacity of the track 23 is at a low level (about 30 pcs airsoft bullets 5 or one half of the full storage capacity). At this time, the user can operate the operating tip 411 of the adjustment member 4 to move the operating tip 411 to the second position 312 in the elongated slot 31 (see FIG. 12) and to bias the retaining tip 432 of the adjustment member 4 to the inner position 4B where the protruding portion 271 of the guide block 27 is released from the constraint of the retaining tip 432 for allowing insert of much more airsoft bullets 5 into the track 23 to move the guide block 27 to the rear end of the track 23. At this time, the bullet storage capacity of the track 23 is at a high level (about 60 pcs airsoft bullets 5 or the full storage capacity).

As stated above, the user can operate the operating tip 411 at the bottom side of the bottom cover 3 to shift the retaining tip 432 into contact with or away from the guide block 27 between the outer position 4A and the inner position 4B to adjust the storage capacity of the airsoft bullet 5 without detaching the bottom cover 3 or pulling the inner shell 2 out of the outer shell 1. When compared with the prior art design, the invention has the advantage of ease of operation. Therefore, the invention involves an inventive step and is industrially applicable.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A gun magazine comprising:

an outer shell made in the form of a vertically extending double open ended shell;

an inner shell mounted inside said outer shell, said inner shell comprising a track defined therein, an opening located in a top side thereof in communication with a front end of said track, a locating rod located in an opposing rear end of said track, a spring member mounted in said track, said spring member comprising a first end facing toward said opening and an opposing second end mounted on said locating rod, and a guide block supported on said first end of said spring member and movable in and out of said opening;

a bottom cover affixed to a bottom side of said inner shell and a bottom side of said outer shell, said bottom cover comprising an elongated slot disposed in communication with said track; and an adjustment member inserted through said elongated slot of said bottom cover, said adjustment member comprising a retaining tip suspending inside said inner shell, said adjustment member being operable to move said retaining tip between an outer position where said retaining tip is shifted into said track to stop said guide block in a mid part of said track and an inner position where said retaining tip is shifted out of said track for allowing movement of said guide block to the rear end of said track to compress said spring member toward;

wherein:

said adjustment member further comprises a lever inserted through said elongated slot of said bottom cover, said lever comprising a top end disposed inside said outer shell and an opposing bottom end disposed outside said outer shell and terminating in an operating tip, a guide rod formed integral with the top end of said lever and terminating in said retaining tip, and a pivot holder formed integral with the top end of said lever and pivotally connected to said inner shell, said operating tip of said adjustment member being operable to move said lever between a first position in one end of said elongated slot and a second position in an opposite end of said elongated slot, said retaining tip being shifted to said outer position when said operating tip is operated to move said lever to said first position, said retaining tip being shifted to said inner position when said operating tip is operated to move said lever to said second position.

2. The gun magazine as claimed in claim 1, wherein said guide block comprises a protruding portion located at a rear end thereof adapted for stopping against said retaining tip when said retaining tip is shifted into said track to stop against said guide block.

3. The gun magazine as claimed in claim 2, wherein said inner shell comprises a through hole; said pivot holder is pivotally connected to said inner shell to keep said adjustment member in between said inner shell and said outer shell; said guide rod comprises an angled rod body extended from the top end of said retaining tip and inserted through said through hole of said inner shell into the inside of said inner shell and terminating in said retaining tip.

* * * * *